United States Patent [19]

Uehara

[11] Patent Number: 4,756,049

[45] Date of Patent: Jul. 12, 1988

[54] SELF-PROPELLED CLEANING TRUCK

[75] Inventor: Masao Uehara, Kyoto, Japan

[73] Assignee: Murata Kaiki Kabushiki Kaisha, Kyoto, Japan

[21] Appl. No.: 878,132

[22] Filed: Jun. 25, 1986

[30] Foreign Application Priority Data

Jun. 21, 1985 [JP] Japan ..... 60-136711

[51] Int. Cl.[4] ..... A47L 5/14

[52] U.S. Cl. ..... 15/340; 15/312 R; 15/319

[58] Field of Search ..... 15/312 R, 319, 312 A, 15/340, 330

[56] References Cited

U.S. PATENT DOCUMENTS

| | | | |
|---|---|---|---|
| 1,245,629 | 11/1917 | Smith | 15/330 |
| 1,399,165 | 12/1921 | Spencer | 15/330 |
| 3,009,838 | 11/1961 | Preston | 15/312 A X |
| 3,010,129 | 11/1961 | Moore | 15/312 R X |
| 3,372,425 | 3/1968 | Black | 15/312 A |
| 3,601,840 | 8/1971 | Pipes | 15/312 A |
| 3,789,939 | 2/1974 | Geislinger | 15/319 X |
| 4,042,998 | 8/1977 | Blough et al. | 15/312 A |
| 4,114,711 | 9/1978 | Wilkins | 15/319 X |
| 4,121,317 | 10/1978 | Sohler | 15/312 A |

*Primary Examiner*—Chris K. Moore

*Attorney, Agent, or Firm*—Barnes, Kisselle, Raisch, Choate, Whittemore & Hulbert

[57] ABSTRACT

A fly waste removing system comprising a self-propelled cleaning truck for removing fly waste and the like and a fly waste discharging station. A blower and a suction duct connected to the blower are carried on a self-propelled truck, and a fly waste storing box is located between the suction duct and the blower with a suction opening of the duct opened to a floor.

3 Claims, 6 Drawing Sheets

SELF-PROPELLED CLEANING TRUCK

FIELD OF THE INVENTION AND RELATED ART STATEMENT

The present invention relates to a self-propelled cleaning truck for removing fly waste and the like in a textile factory.

In a spinning mill in which a large number of textile machines such as spinning frames and automatic winders are installed, production of a large amount of fly waste cannot be avoided. Particularly on ring spinning frames or pneumatic spinning frames for production of spun yarns from staple fiber, a large amount of fly waste is produced at a portion for drafting staple fibers or at a portion for taking up a spun yarn, and on automatic winders, a large amount of fly waste is produced upon releasing of yarn ends from yarn supply bobbins and due to contact between winding packages and traverse drums.

Such fly waste will have various harmful influences by its scattering into the atmosphere, accumulation on a floor or adhesion to machines. In particular, fly waste in the atmosphere and on a floor principally deteriorates operating environment of workers while fly waste adhering to machines causes various troubles or disadvantages such as deterioration of yarns themselves to be worked, and malfunction and/or braking of machines will be caused by fly waste adhering to and/or accumulated on rotary members of the machines.

Accordingly, various apparatus have been proposed so far as countermeasures for such fly waste. For example, such apparatus as disclosed in Japanese laid-open patent No. Sho 51-6779 and Japanese laid-open utility models No. Sho 53-69536 and No. Sho 53-69537 have an object to prevent scattering of fly waste into the atmosphere, and an apparatus disclosed in Japanese laid-open utility model No. Sho 53-4268 has an object to prevent adhesion of fly waste to a machine.

Although a large amount of fly waste will accumulate at various places of passages between machines and floors in a factory in which a large number of machines are installed, there exists no effective cleaning apparatus, and such fly waste is actually removed by cleaning by operators.

OBJECT AND SUMMARY OF THE INVENTION

It is an object of the present invention to provide an apparatus which can automatically remove fly waste on a floor to clean the latter in a spinning mill and the like.

According to the present invention, a blower and a suction duct connected to the blower are carried on a self-propelled truck, and a fly waste box is located between the suction duct and the blower with a suction opening of the duct adjacent to and exposed to a floor.

BRIEF DESCRIPTION OF THE DRAWING

FIG. 7 a diagrammatic plan view illustrating an example of arrangement of travelling passages for the truck, discharging stations, a charging station and so on.

DETAILED DESCRIPTION OF PREFERRED EMBODIMENTS

Figure 1:
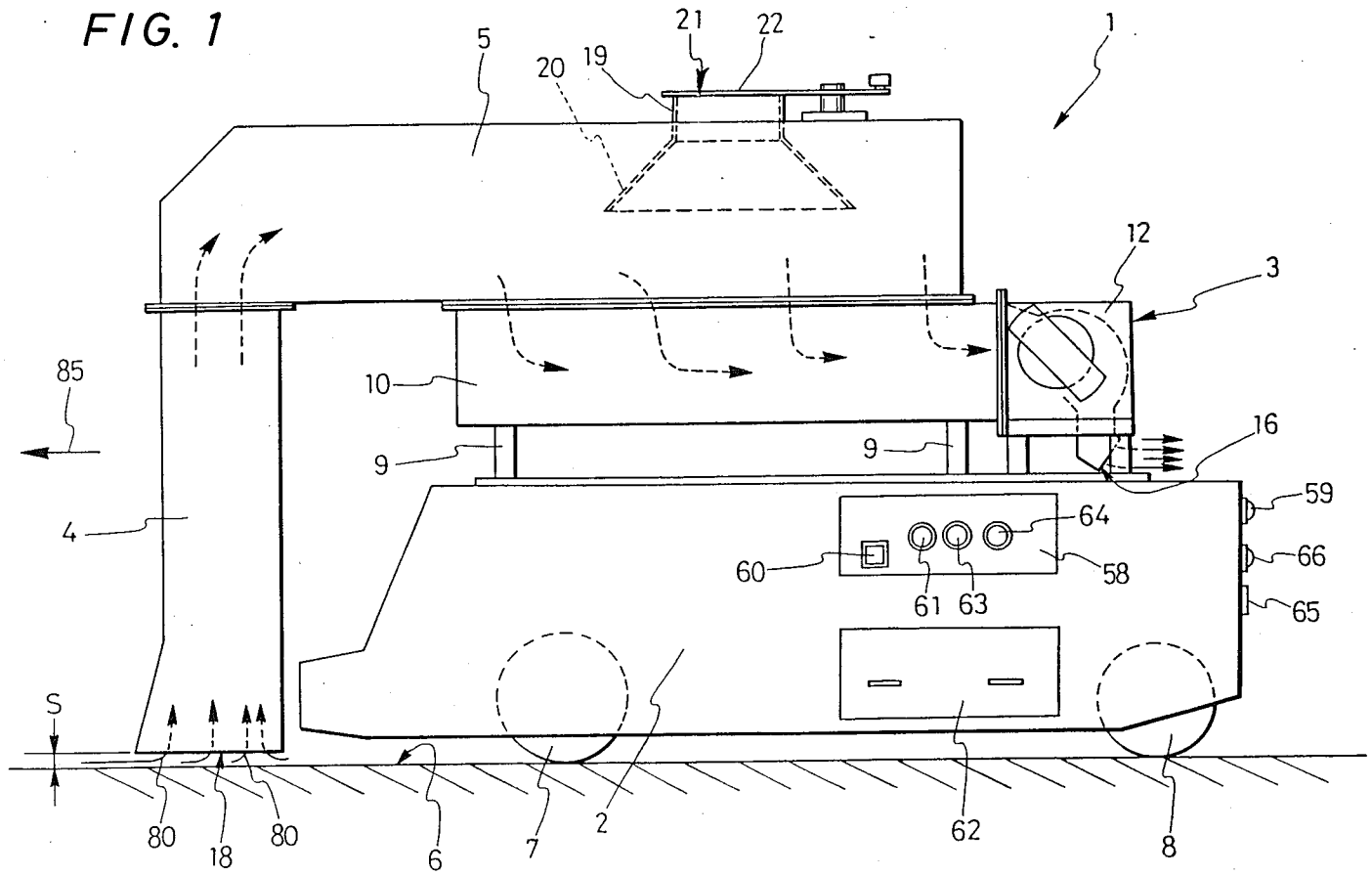
FIG. 1 is a side elevational view showing an embodiment of a self-propelled cleaning truck.

Referring to FIG. 1, there is illustrated an embodiment of a cleaning truck. The cleaning truck 1 includes a truck body 2, and a blower 3, a suction duct 4 and a fly waste storing box 5 which are all carried on the truck body 2.

The truck body 2 can be a truck which travels, without a driver, while detecting an electromagnetic guide line or any other guide line such as a white tape laid on a floor 6. It is also possible to omit such guide lines while employing a truck body 2 of the type which travels under control of a computer.

Figure 2:
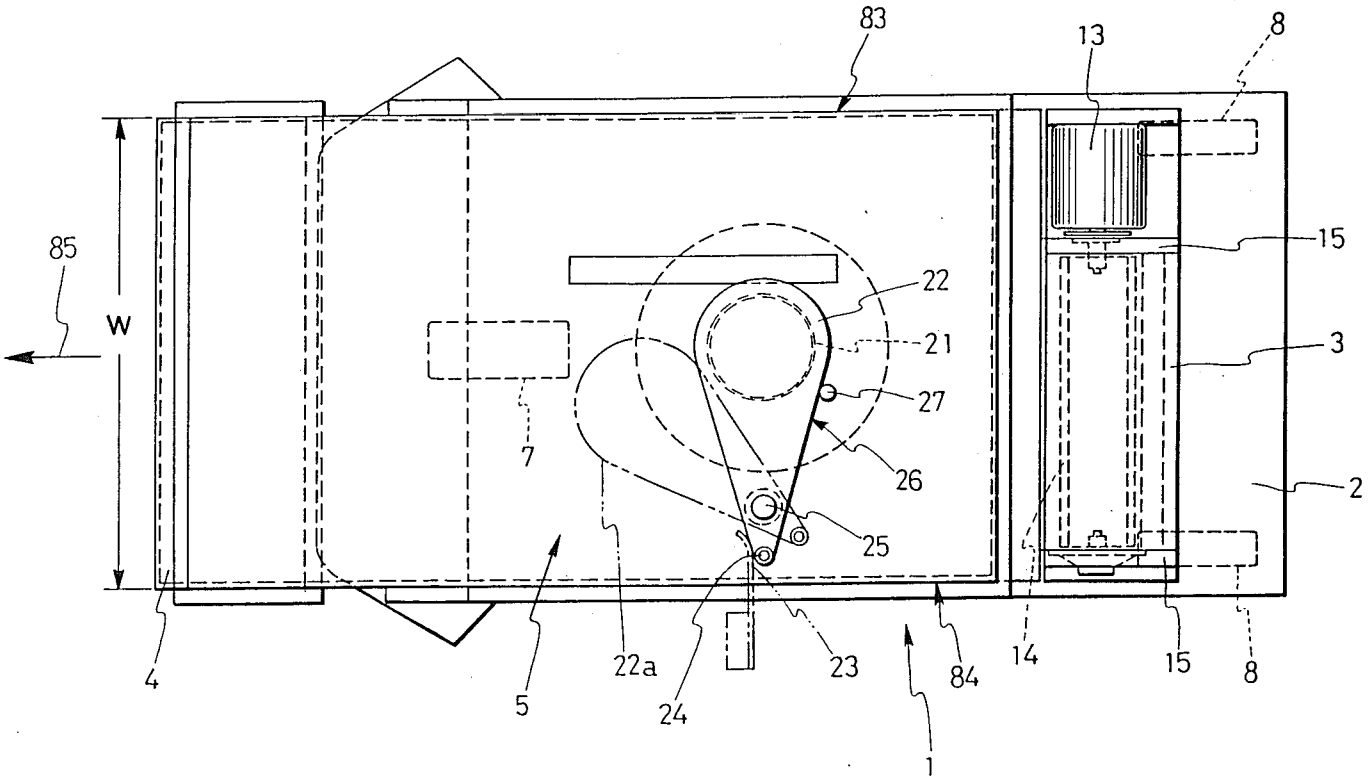
FIG. 2 a plan view of the truck of FIG. 1.
Figure 3:
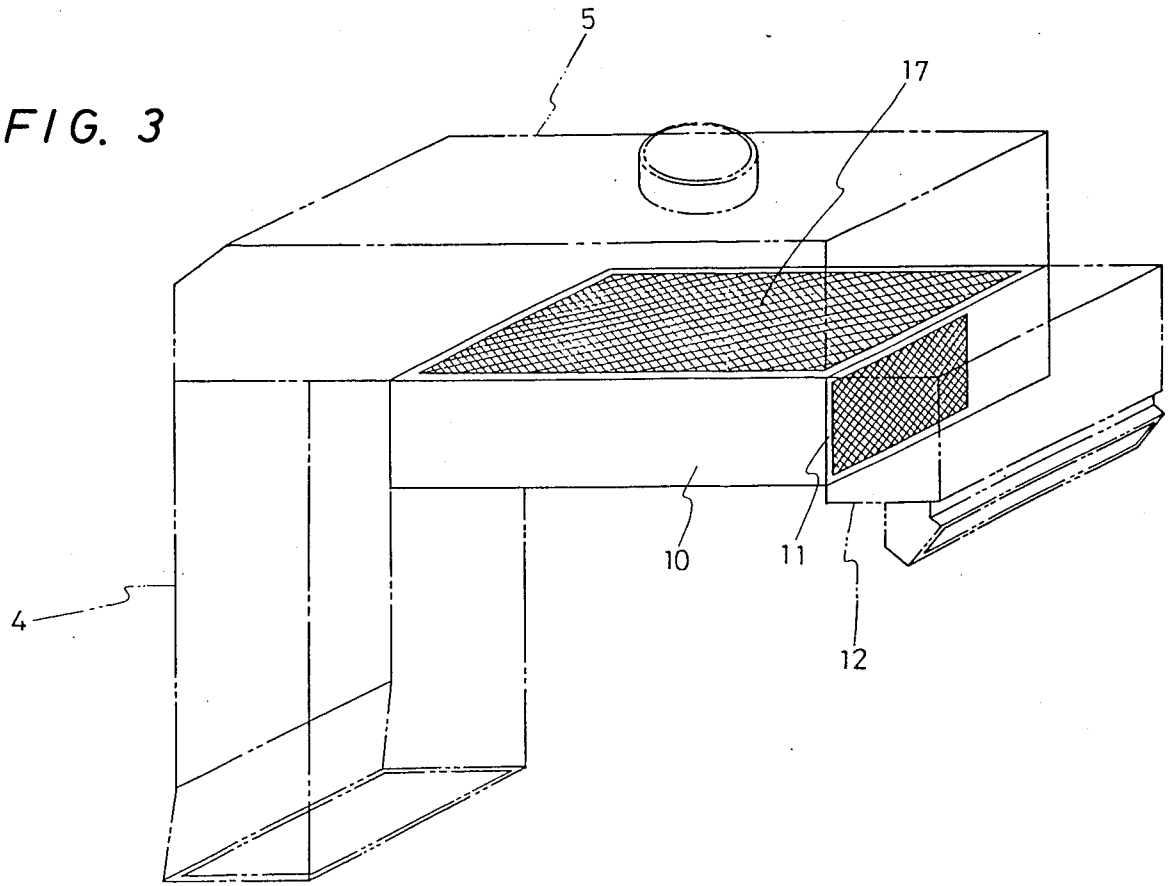
FIG. 3 a perspective view illustrating the relative portions of a suction duct, a fly waste storing box and a blower device.

A duct 10 is securely mounted on the truck 2 by means of support members 9, and an opening at a rear end of the duct 10 is connected to a blower box 12 with a filter 11 interposed therebetween as seen in FIG. 3. Within the blower box 12, a fan 14 is supported on a pair of brackets 15 at opposite ends of the blower box 12 and is connected to be rotated by a motor 13 as shown in FIG. 2. The blower box 12 has an air outlet port 16 formed therein, and as the fan 14 is rotated, negative pressure is produced in the duct 10.

The fly waste storing box 5 is connected to an opening at the top of the duct 10 with a filter 17 interposed therebetween, and the suction duct 4 is connected to the fly waste storing, box 5 and has a suction port 18 formed therein adjacent to and open to the floor 6.

Various types of blowers can be used in the blower box 12, and, depending upon types of blade rotated by a motor, there will be a difference in static pressure obtained within the suction duct 4. The static pressure is necessarily dependent upon the objects which are to be picked up such as fly waste and dust, and where it is a principal object to only absorb fly waste which is afloat near a floor, it is necessary to use a blower which yields low static pressure, but where it is intended to pickup also heavier objects including fly waste, waste yarns and dust which adhere on a floor and are somewhat moistened, a blower which can yield high static pressure is necessarily installed. Anyway, a suitable blower is employed depending upon the types of factories and conditions of floors. Accordingly, the blower box 12 is removably mounted on the duct 10 and an, an optimum blower can be used.

In the meantime, while the sucking action can be performed more effectively if the distance S between the opening 18 at the bottom of the suction duct 4 and the floor 6 is reduced, preferably the distance S is such as to assure no contact of the lower end of the duct with the floor even by rocking motion of the truck during travelling, or with foreign articles on the floor, and 10 to 30 mm may be sufficient for the distance S.

Now, a mechanism for discharging a mass of fly waste collected within the fly waste storing box 5 of the truck will be described with reference to FIGS. 1, 2, 4 and 5.

A communicating member 21 is securely mounted on the truck and includes a cylindrical member 19 and a funnel-shaped member 20 formed in an integral relationship with the cylindrical member 19 as seen in FIGS. 1 and 2. The cylindrical member 19 extends through an opening in a top wall of the fly waste storing box 5. A movable lid member 22 is located adjacent an opening at the top of the communicating member 21 and is mounted for pivotal motion on the box 5. The lid member 22 is swiveled between a position shown in full lines in FIG. 2 and another position shown in phantom in the same figure by a fixed cam plate 23 at a fly waste discharging station. Reference numeral 24 denotes a cam follower, and a torsion spring not shown is wrapped around a shaft 25 for urging the lid member 22 in a clockwise direction. While the truck is travelling, the lid member 22 is engaged at a side edge 26 thereof with and positioned by a stop pin 27 on the box 5 so that the opening at the top of the communicating member 21 is in its closed condition.

It is to be noted that it is also possible to replace the torsion spring with a tension spring which is extended between the lid member 22 and the box 5 in order to obtain the urging force for the lid member 22.

Figure 5:
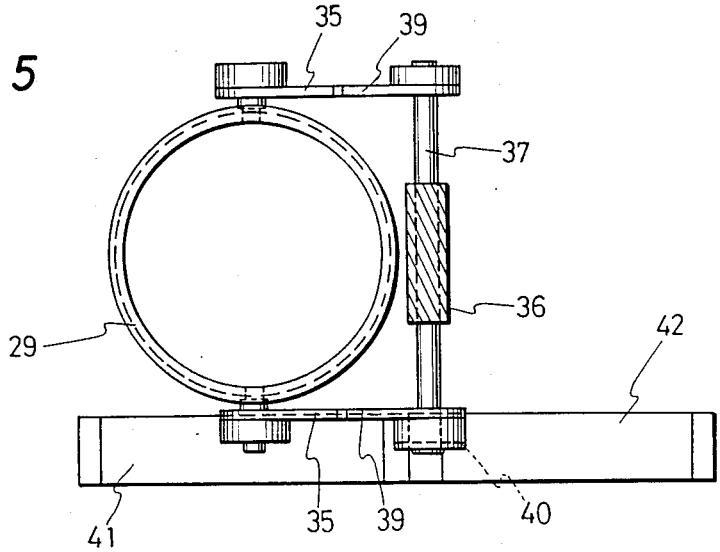
FIG. 5 a plan view of the relationship of FIG. 4.
Figure 4:
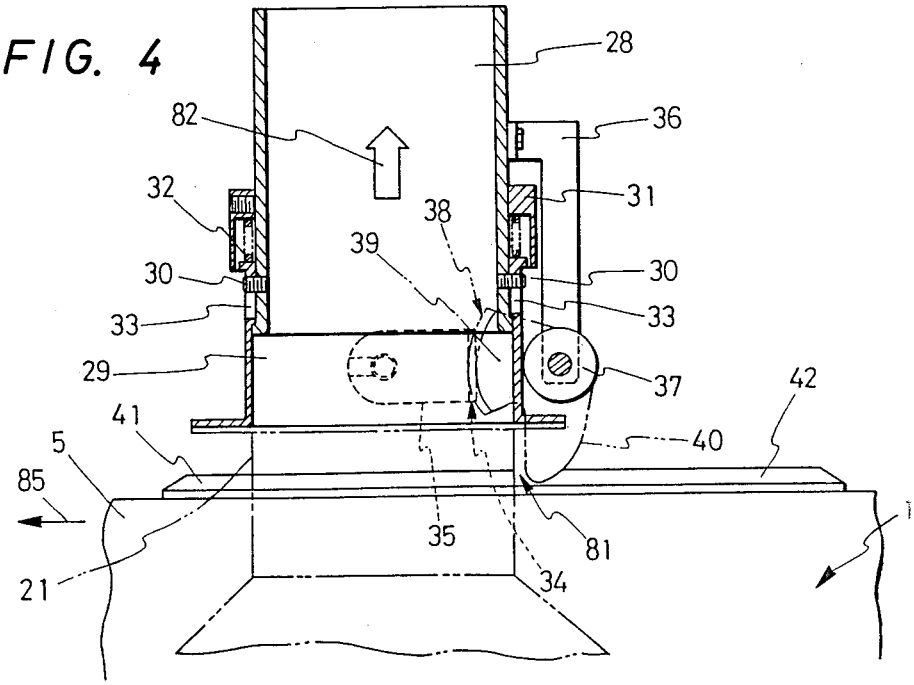
FIG. 4 a side elevational sectional view illustrating a communicating relationship between the suction duct and the truck in a fly waste mass discharging station.

Meanwhile, a sucking device as shown in FIGS. 4 and 5 is installed at the fly waste discharging station. In particular, a discharging duct 28 is fixedly installed at a position of the fly waste discharging station adjacent which the truck stops. The discharging duct 28 is connected to a concentrated sucking blower not shown. A movable cylindrical member 29 is supported at a lower end portion of the discharging duct 28 by means of a pair of pins 30 and mounted for up and down movement along the discharging duct 28. The movable cylindrical member 29 is urged downwardly by a spring 32 located in a spring-retainer member 31 securely mounted around an outer periphery of the duct 28 and is normally at a position as shown in full lines in FIG. 4 due to engagement of the pins 30 with elongated holes 33 formed at a plurality of locations of the cylindrical member 29.

Further, a pair of plates 35 each having a rack 34 formed to extend in a vertical direction on an end face thereof are securely mounted on the cylindrical member 29. A shaft 37 is supported on the duct 28 by means of a bracket 36, and a pair of levers 39 are supported on the shaft 37 and each have teeth 38 formed thereon and meshed with the rack 34. A cam lever 40 is formed at part of one of the levers 39 and positioned to be operated by a pair of cam plates 41 and 42 secured to the truck 1. In particular, as the truck is arriving at the discharging station, the cylindrical member 29 is moved up once to a position in which it does not interfere with the communicating member 21 extending upwardly from the box 5 of the truck, and thus when the truck stops at a predetermined position, the top end face of the communicating member 21 is closely contacted with the bottom end face of the movable cylindrical member 29 thereby to establish a discharging passage for a mass of fly waste.

Figure 6:
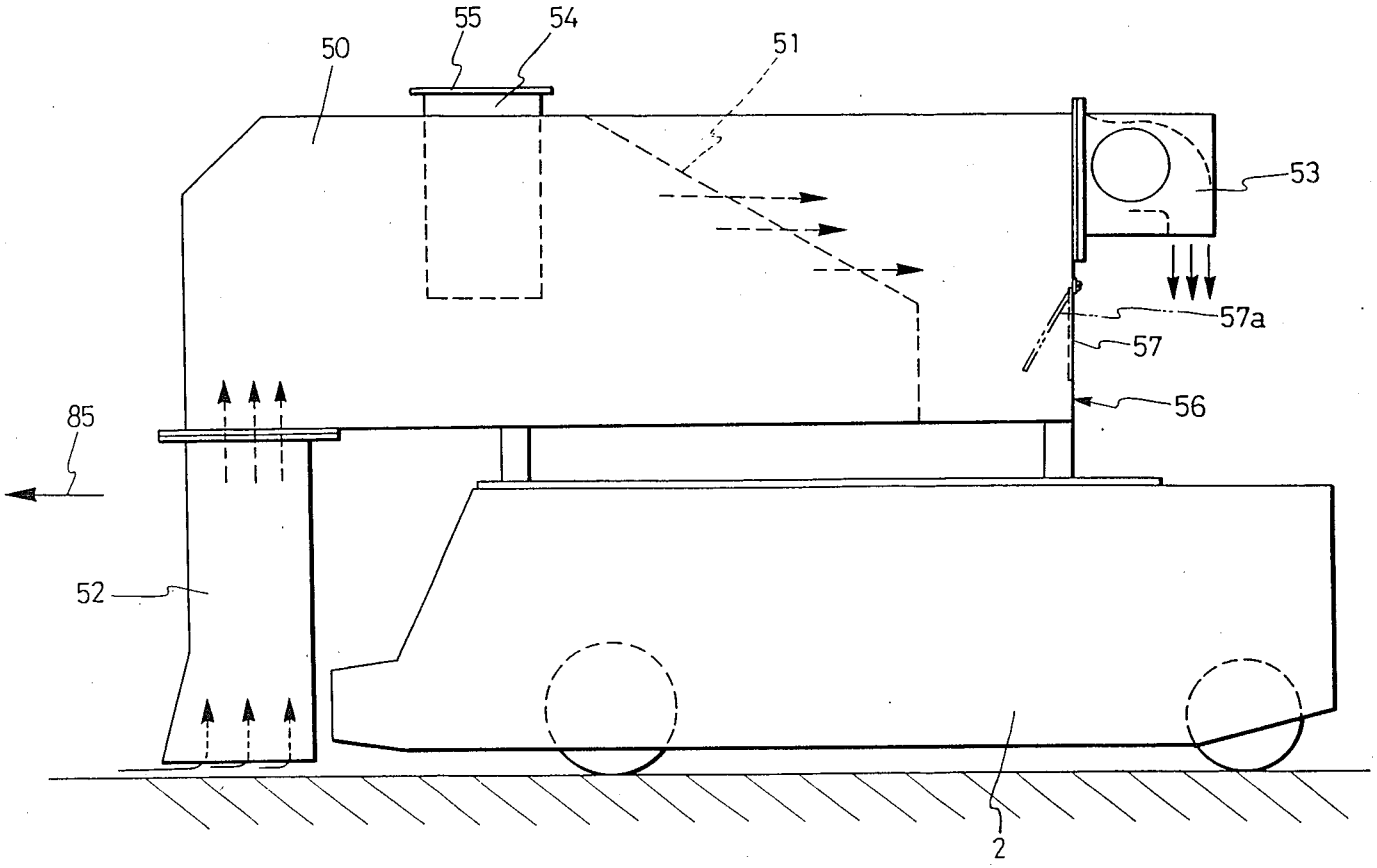
FIG. 6 a side elevational view showing another embodiment of a self-propelled cleaning truck.

FIG. 6 illustrates another embodiment of cleaning apparatus installed on a truck. In this embodiment, the area of a filter 51 located in a fly waste storing box 50 is increased to increase its capacity of storing fly waste. Thus, fly waste sucked from the suction duct 52 is adhered to and accumulated on a face of the filter 51. Reference numeral 53 denotes a blower device similar to that of the preceding embodiment. Reference numeral 54 denotes a communicating member for discharging a mass of fly waste from a box therethrough. The communicating member 54 has a cylindrical shape with a pair of openings at opposite ends and has at the opening at the top end thereof, a lid member 55 similar to that of the preceding embodiment.

It is to be noted that in this embodiment a hinged door 57 is provided at a rear end face 56 of the box 50 in order to allow a reverse flow of air for discharging fly waste accumulated on the inclined filter 51. At the discharging station, the door 57 is opened to a phantom position **57*a* to allow air to flow in through the opening thereby to produce air flow through the filter 51 and then into the communicating member 54 to exfoliate and separate the fly waste from the filter 51**, thereby facilitating discharging of the fly waste.

Further, it is also possible to provide, in any of the embodiments of FIGS. 1 and 6, a shutter for preventing air from flowing in from the suction duct 4 or 52 at a position intermediately of the suction duct 4 in order to further promote air flows for discharging fly waste at the discharging station.

Referring to FIG. 1, it is to be noted that an operation panel 58, lamps 59 and 66 and so on are provided on the truck 2. Also provided on the truck 2 are several switches 60 for a power source and for starting and stopping, a lamp 61 which is lit upon emergency of electric circuit systems for driving and steering motors and so on, a switch 63 for resetting a running time accumulator to zero after charging of a battery 62, a lamp 64 which is lit during cleaning, a buzzer 65 which makes sounds if the sucking force of the suction duct becomes low, pilot lamps 59, 66 for indicating that the truck is travelling, and so on.

Figure 7:
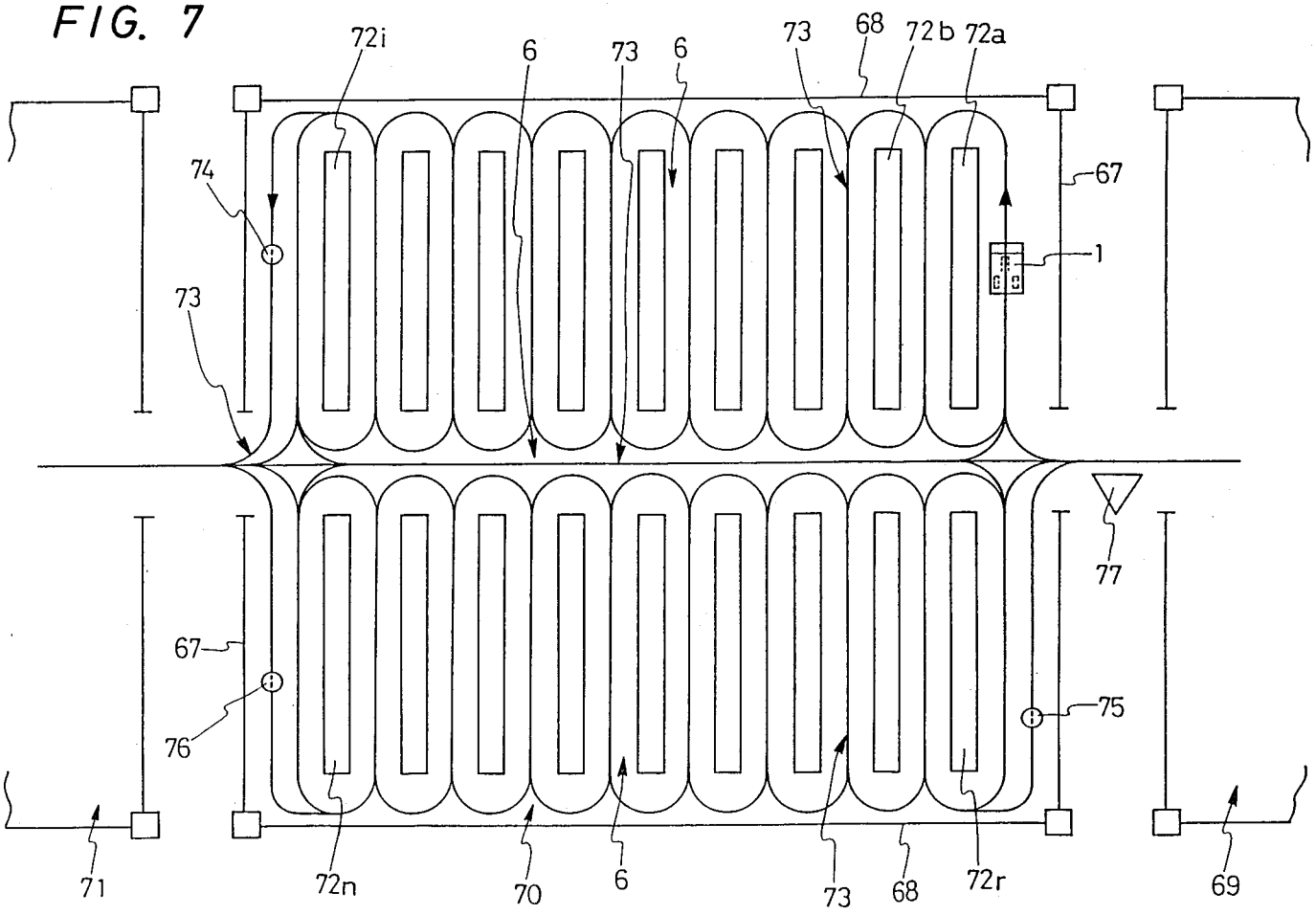

An example of a layout of a spinning mill in which such a self-propelled cleaning truck as described above is provided is illustrated in FIG. 7. Naturally, one or more such cleaning trucks 1 may travel in the mill. In each of factories 69 to 71 which are each encircled by walls 67 and 68, a large number of textile machines **72*a* to 72*n* such as spinning frames or winders are arranged in an orderly fashion, and a guide line 73 for guiding a truck therealong such as a conductor or a tape is laid along each of passages 6 between the adjacent textile machines. Fly waste discharging stations 74 to 76 are provided at suitable positions. A charging station 77 for exchanging or charging a battery on a truck can also be provided. Thus, an automatic fly waste collecting and discharging system is constituted by a self-propelled cleaning truck 1, the guide lines 73, the fly waste discharging stations 74 to 75 and the charging station 77**.

In the apparatus described above, during travelling of a truck along a guide line, fly waste on a floor will be sucked into the suction duct 4 as shown in FIG. 1 together with air 80 flowing into the suction duct 4 and will be accumulated on the filter 17 within the fly waste storing box 5. It is to be mentioned that since the suction duct 4 has a suction port of a width W substantially same as the width of a truck as seen in FIG. 2, fly waste is sucked from an area over which a truck passes and also from an additional wider area over which suction air acts.

If accumulation of fly waste increases so that the sucking force becomes lower, the truck will travel in a direction of an arrow mark 85 toward a fly waste discharging station. Upon arrival at the station, the cam lever 40 on the stationary side of FIGS. 4 and 5 is pivoted by the cam 41 on the truck 1 to lift the cylindrical member 29 against the spring 32 by way of the rack 34 meshed with the arcuate toothed face 38 of the lever 39. At the same time, the roller 24 at the end of the lid member 22 on the truck is engaged with the cam 23 on the stationary side as shown in FIG. 2 to pivot the lid 22 from the full line position to the phantom position 22*a* as the truck travels further. As a result, the top of the communicating member 21 is opened. Then, as the truck is stopped and the communicating member 21 on the truck is now positioned below the cylindrical member 29, the cam lever 40 comes to a concave portion 81 between the cams 41 and 42 to allow the cylindrical member 29 to be lowered to establish connection between the fixed duct 28 and the communicating member 21. Then, in response to a truck arriving signal from a switch or the like not shown, suction air flows are produced to act in the duct 28 in a direction of an arrow mark 82 in FIG. 4. As a result, masses of fly waste stored within the box 5 of the truck are sucked and discharged therefrom.

After discharging of such fly waste masses from the box 5, the truck will start travelling again. Thereupon, the cam 42 shown in FIG. 4 pivots the cam lever 40 again to slightly lift the cylindrical member 29 while the roller 24 of the lid member 22 of FIG. 22 is disengaged from the cam 23 to allow the lid member 22 to be returned to the full line position by the spring force to close the opening at the top of the communicating member 21. As the truck travels further, the cam 42 of FIG. 4 is disengaged from the lever 40. As a result, the cylindrical member 29 is moved downwardly back to its stand-by position by the force of the spring 32.

It is to be noted that while in the embodiments described above the suction duct 4 is mounted on the front side of the truck 2, such modification is also possible as to mount a suction duct at a rear end or at each of front and rear ends or of opposite sides of a truck. The location of the blower device 3 can also be changed depending upon locations of the suction duct 4 and the fly waste storing box 5. Further, the discharging device for fly waste masses shown in the drawings is only an example, and it can be constituted otherwise such that the communicating member 21 at the top of the box 5 of FIG. 2 is omitted and instead, a pair of opposite side plates 83 and 84 of the box 5 are mounted for opening and closing movement so that with both side plates opened, the fixed suction duct may be connected from one side thereto in order to allow fly waste masses to be discharged.

As apparent from the foregoing description, according to the present invention, a suction duct for sucking fly waste on a floor and a fly waste storing box are provided on a truck which travels on the floor. Accordingly, the truck can remove fly waste, dust and the like on a floor and is thus particularly effective for a factory or the like in which a large number of textile machines are installed.

What is claimed is:

1. A fly waste removing system comprising a self-propelled cleaning truck which includes a self-propelled truck, a blower, a first suction duct connected to the blower and having a suction opening for sucking fly waste and the like, and a fly waste storing box located between said blower and said first suction duct, said blower, first suction duct and fly waste storing box being carried on said self-propelled truck, a fly waste discharging station, programmed to stop at predetermined times at said fly waste a mechanism in said fly waste storage box for discharging a mass of fly waste collected within the fly-waste storing box, said mechanism comprising a communicating member which includes a cylindrical member extending through an opening in a top wall of the fly waste storing box, a funnel-shaped member formed in an integral relationship with the cylindrical member, and a movable lid member which is located adjacent an opening at the top of the communicating member selectively to close the opening of the communicating member and mounted for pivotal motion on the fly waste storing box.

2. A fly waste removing system comprising a self-propelled cleaning truck which includes a self-propelled truck, a blower, a first suction duct connected to the blower and having a suction opening for suckig fly waste and the like, and a fly waste storing box located between said blower and said first suction duct, said blower, first suction duct and fly waste storing box being carried on said self-propelled truck, a fly waste discharing station, a mechanism in said fly waste storage box for discharging a mass of fly waste collected within the fly-waste storing box, said mechanism comprising a communicating member which includes a cylindrical member extending through an opening in a top wall of the fly waste storing box, a funnel-shaped member formed in an integral relationship with the cylindrical member, and a movable lid member which is located adjacent an opening at the top of the communicating member selectively to close the opening of the communicating member and mounted for pivotal motion on the fly waste storing box, said fly waste discharging station including a discharging duct installed to cooperate with said communication member when the self-propelled cleaning truck stops, and a movable cylindrical member supported at a lower end portion of the discharging duct, said movable cylindrical member being mounted for up and down movement along the discharging duct and urged downwardly by a spring whereby a top end face of the communicating member is closely contacted with the bottom face of the movable cylindrical member to establish a discharging passage for a mass of fly waste when the truck arrives at the discharging station.

3. A fly waste removing system comprising a self-propelled cleaning truck which includes a self-propelled truck, a blower, a first suction duct connected to the blower and having a suction opening for sucking fly waste and the like, and a fly waste storing box located between said blower and said first suction duct; said blower, first suction duct and fly waste storing box being carried on said self-propelled truck, and a fly waste discharging station;

(a) said first suction duct including an entrance passage and being open to said fly waste storing box, a first filter downstream from said storage box forming one wall of said storage box, a second passage between said first filter and said blower, and a second filter between said second passage and said blower to isolate fly waste from said blower;

(b) said blower comprising a demountable blower box on said truck having an inlet in communication with said second passage and said first duct, a motor in said blower box, a fan provided in the blower box to be connected to and rotated by the motor, and an air outlet port formed on the blower box so that negative pressure is produced in said first duct connected with the blower to accumulate the fly waste on said first filter within said fly waste storing box, said blower box including the motor, fan and air outlet being independently removable from said truck to allow selective replacement with a blower box of varying capacity.

* * * * *

UNITED STATES PATENT AND TRADEMARK OFFICE

CERTIFICATE OF CORRECTION

PATENT NO. : 4,756,049

DATED : July 12, 1988

INVENTOR(S) : Masao Uehara

It is certified that error appears in the above-identified patent and that said Letters Patent are hereby corrected as shown below:

Col. 5, Lines 63-64, delete "programmed to stop at predetermined times at said fly waste".

Col. 6, Line 11, change "suckig" to -- sucking --.

Signed and Sealed this

Twenty-ninth Day of November, 1988

*Attest:*

*Attesting Officer*

DONALD J. QUIGG

*Commissioner of Patents and Trademarks*